US006619674B2

(12) United States Patent
Baldwin

(10) Patent No.: US 6,619,674 B2
(45) Date of Patent: Sep. 16, 2003

(54) ICE SKATEBOARD

(76) Inventor: Michael L. Baldwin, 525 Pioneer Rd., Kalispell, MT (US) 59901

( * ) Notice: Subject to any disclaimer, the term of this patent is extended or adjusted under 35 U.S.C. 154(b) by 0 days.

(21) Appl. No.: 10/014,669

(22) Filed: Dec. 14, 2001

(65) Prior Publication Data

US 2002/0043775 A1 Apr. 18, 2002

(51) Int. Cl.[7] ..... B62B 13/04; A63C 1/34

(52) U.S. Cl. ..... 280/14.25; 280/11.18; 280/87.042

(58) Field of Search ..... 280/14.21, 14.25, 280/28, 11.12, 87.042, 14.26, 11.18

(56) References Cited

U.S. PATENT DOCUMENTS

| | | | | | |
|---|---|---|---|---|---|
| 255,161 | A | * | 3/1882 | Gault | 280/87.042 |
| 1,826,958 | A | * | 10/1931 | Sayer | 280/87.042 |
| 3,061,324 | A | * | 10/1962 | Murray | 280/87.042 |
| 3,583,722 | A | * | 6/1971 | Jacobson | 280/87.042 |
| 4,043,565 | A | * | 8/1977 | Mogannam | 280/87.042 |
| 4,114,913 | A | * | 9/1978 | Newell et al. | 280/87.042 |
| 4,165,091 | A | * | 8/1979 | Chadwick | 280/87.042 |
| 4,225,145 | A | * | 9/1980 | Carr | 280/87.042 |
| D261,168 | S | * | 10/1981 | Rice, Jr. | D21/225 |
| 4,392,658 | A | * | 7/1983 | Redmond et al. | 280/11.18 |
| 4,521,029 | A | * | 6/1985 | Mayes | 280/87.042 |
| 4,896,893 | A | * | 1/1990 | Shumays et al. | 280/87.042 |
| 5,161,810 | A | * | 11/1992 | DeCesare | 280/87.042 |
| D364,127 | S | * | 11/1995 | Scherr et al. | D12/6 |
| 5,566,956 | A | * | 10/1996 | Wang | 280/87.042 |
| 5,641,169 | A | * | 6/1997 | Bekessy | 280/11.18 |
| 6,270,096 | B1 | * | 8/2001 | Cook | 280/87.042 |
| 6,311,990 | B1 | * | 11/2001 | Landry | 280/87.042 |
| 6,474,660 | B1 | * | 11/2002 | Warren | 280/7.12 |

* cited by examiner

*Primary Examiner*—Brian L. Johnson
*Assistant Examiner*—Jeffrey Restifo
(74) *Attorney, Agent, or Firm*—Dennison, Schultz & Dougherty

(57) ABSTRACT

An ice board including a platform for supporting an individual in a standing or crouched position, a pair of single in line ice runners disposed below and fixed to the platform, and a brake member, a first or forward ice runner defines a curved ice engaging surface which curves upwardly toward the front of the platform while the rear ice runner includes a flat ice engaging surface over about 80 percent of its length. The rear ice runner also includes a curved surface at the rear thereof for rotating the front of a platform upwardly and for bringing the brake member into engagement with the ice to slow or stop momentum of the ice board on the ice.

2 Claims, 3 Drawing Sheets

ICE SKATEBOARD

FIELD OF THE INVENTION

This invention relates to a skateboard for use on icy surfaces and more particularly to an ice skateboard with a pair of single in line ice runners or blades.

BACKGROUND OF THE INVENTION

Ice boards which have multiple pairs of ice runners are disclosed in the Mayes U.S. Pat. No. 4,521,029. As disclosed therein, an ice board includes pairs of skates which are mounted for unrestrained pivotal movement about axes. The axes extend laterally from trucks depending the ice board's platform. Each skate has a protrusion extending upwardly at a distance sufficient to engage a forward portion of the platform to prevent the forward portion from engaging the ice and a bumper guard is mounted on each protrusion.

A more recent approach to ice skateboards is disclosed in the DeCesare U.S. Pat. No. 5,161,810. As disclosed therein, an ice skateboard includes an elongated platform having front and rear portions and conventional skateboard trucks with transverse axles supported by a structure which facilitates slight controllable swinging movement of the axle in response to the shifting of weight on the platform. Each of the front and rear axles rotatably support a pair of transversely spaced blades or runners.

It is now believed that there may be a market for a more challenging ice board which includes a pair of single in line ice runners in accordance with the present invention. It is also believed that the ice boards as disclosed herein will allow an individual to perform many of the maneuvers performed on conventional land based skateboards. Further the ice boards in accordance with the present invention may be manufactured at a relatively low cost and are of durable construction.

BRIEF SUMMARY OF THE INVENTION

In essence, the present invention contemplates a skateboard for use on ice or icy surfaces. The skateboard includes an elongated platform or board member having front, middle and rear portions. The board member also includes an upper and bottom surface and a width and thickness to accommodate an individual in a standing, crouched or generally upright position. A pair of single in line ice runners for engaging an icy surface are disposed below and fixed to the bottom surface of the elongated board member. The ice board is free of other ice engaging surfaces other than a brake which is free of the ice during normal gliding movements but which may be brought into contact with the ice. In a preferred embodiment of the invention the ice runners have a thickness of about 1/16 to 3/16 inches and are longitudinally separated from one another by a distance of at least one or two skate or runner lengths. A first or forward ice runner includes a curved ice engaging surface which curves upwardly toward the bottom of the elongated board member out of contact with the icy surface over at least 50 percent and preferably 80 percent or more of the length of the runner. In effect, the runner is similar to the blades on a pair of figure skates. By shifting an individuals weight to a forward portion of the board and leaning in the direction of a desired turn, one edge of the curved portion of the runner will come into contact with the ice and cause the board to track the curve of the runner or blade.

The second or rear ice runner defines a flat ice engaging surface over at least 75 to 80 percent of its length and is generally similar to the shape of a skate blade for hockey or speed skating. However, in a preferred embodiment of the invention a rear portion of the second or rear runner curves upwardly which allows the platform to be rotated about that portion with the front runner lifted upwardly off of the ice by shifting an individuals weight to a rear portion of the board. This movement will also bring a brake member into contact with the ice.

The invention will now be described in connection with the accompanying drawings.

DESCRIPTION OF THE PREFERRED EMBODIMENTS OF THE INVENTION

Figure 1:
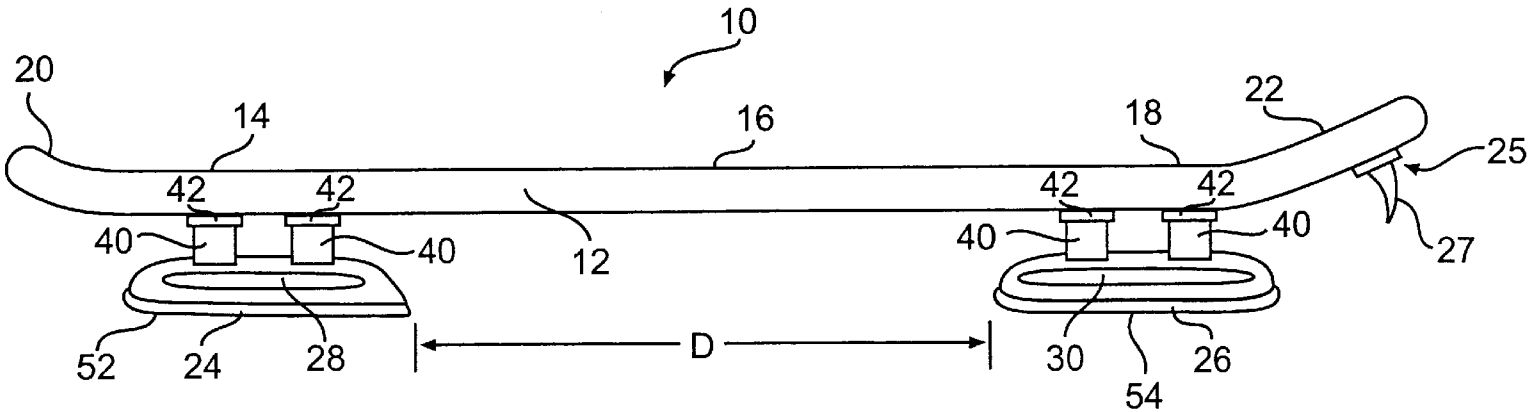
FIG. 1 is a side elevational view of an ice board in accordance with a preferred embodiment of the invention.
Figure 2:
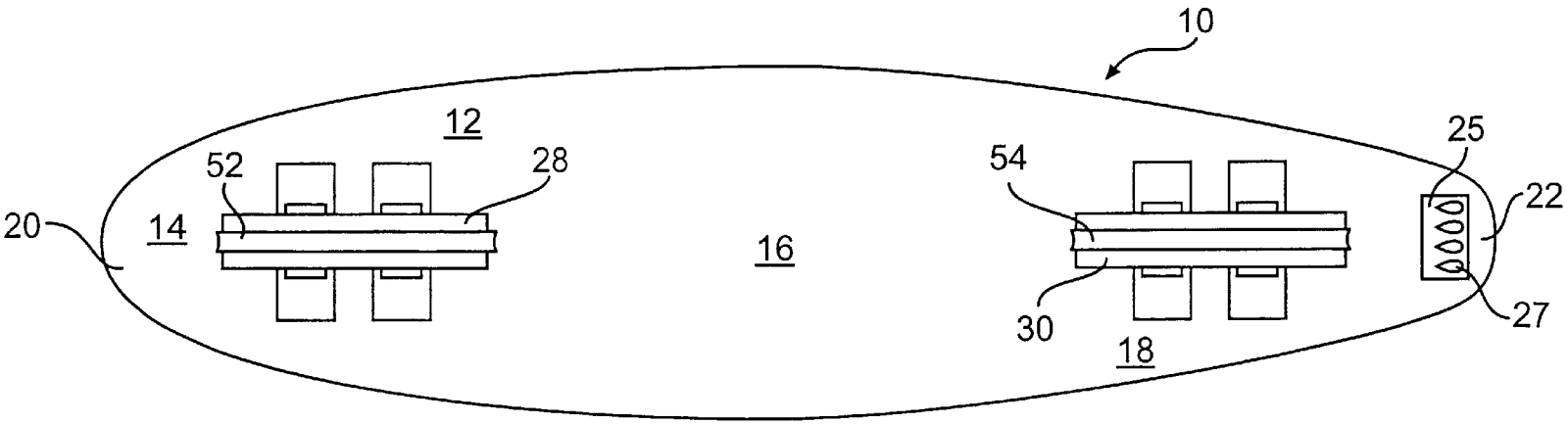
FIG. 2 is a bottom or plan view of the ice board shown in FIG. 1.

As illustrated in FIGS. 1 and 2 an ice board 10 according to a preferred embodiment of the invention includes a rider supporting platform or elongated board member 12 having a forward, middle and rear portion 14, 16 and 18, respectively. The elongated board member 12 may be of any suitable material such as wood, plastic, fiberglass reinforced plastic or metal and has a sufficient thickness to support the weight of an individual in the same manner as done for a land oriented or conventional skateboard. The elongated board member also has upper and lower surfaces and a width sufficient to accommodate an individuals foot. The width can vary from about three to ten inches and may be slightly wider in the front and rear portions 14 and 18 then in the middle portion 16 or wider in the middle portion 16 as shown in FIG. 2. In using the ice board an individual rider will typically place one foot on the forward portion 14 and the other on the rear portion 18 of the board 10 in the same manner as with a conventional skateboard.

The elongated board member 12 is generally flat over much of the forward, middle and rear portions 14, 16 and 18 but may include a raised portion or inclined section 20 in the front of the board member 12 and preferably an elevated portion 22 at the rear of the board member 12.

A pair of single in line ice runners 24 and 26 are fixed to the bottom surface of the board member 12 by means of mounting members 40 and plates 42 in a conventional manner. In addition, housings 28 and 30 may be provided between the ice runners and the mounting members to provide further support for the ice runners 24 and 26.

Figure 3:
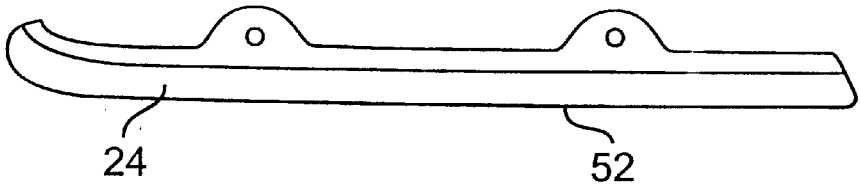
FIG. 3 is a side elevational view of a first or front ice runner or blade of the type incorporated in a preferred embodiment of the invention.

As illustrated in FIG. 3, the blade or ice runner 24 includes an ice engaging surface 52 which defines a slight arc or curved surface that curves upwardly in the front portion thereof toward the bottom of the board member 12. This slight arc preferably extends over at least 50 and preferably 75 to 80 percent of the ice engaging surface in about the same way as a blade used in figure skating or ice dancing. Then in front of the slight arc, the blade turns upwardly so that the runner 24 will ride over minor irregularities in the ice or small twigs or the like.

Figure 4:
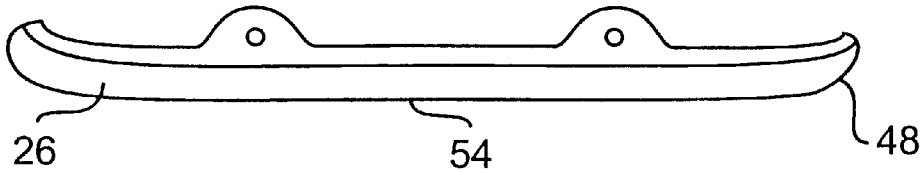
FIG. 4 is side elevational view of a second or rear ice runner or blade of the type incorporated in a preferred embodiment of the invention.
Figure 4A:
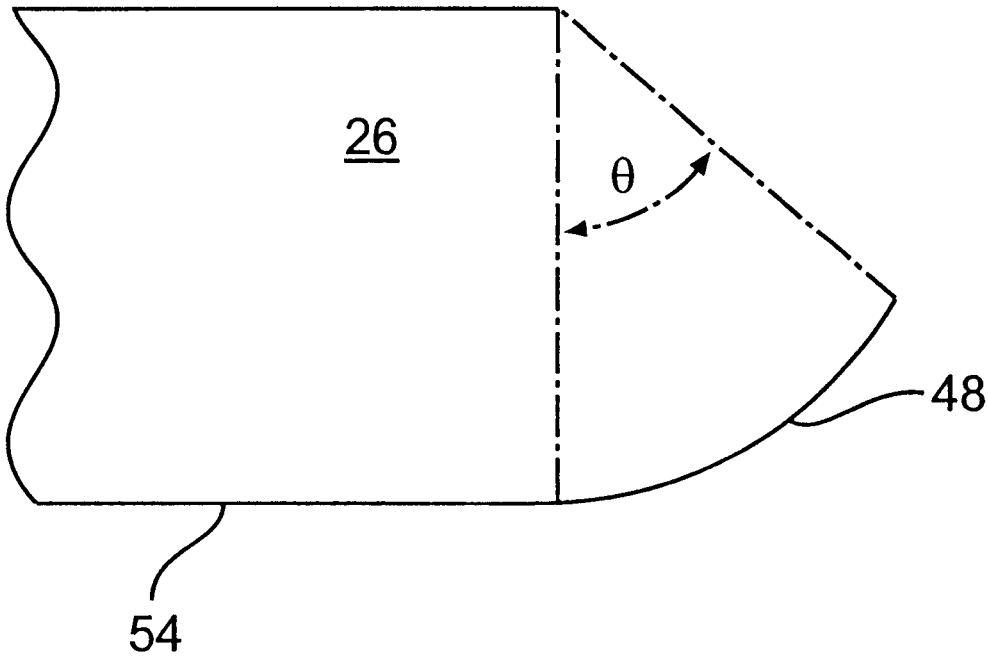
FIG. 4*a* is a side elevational view illustrating a curved rear portion of the rear blade in accordance with a preferred embodiment of the invention.

The second or rear ice runner 26 is shown in more detail in FIG. 4 and 4*a*. As shown therein the ice runner 26 includes a flat ice engaging surface 54 which extends over at least about 75 to 80 percent of its length, a short curved surface 46 in the front of the runner and a curved rear surface 48 at the back of the runner. The curved rear surface 48 describes an arc with an angle $\phi$ of at least about 30 degrees and a radius which is about equal to two times the height of the blade (about ¾ inch to about 1½ inches) when the ice runner is perpendicular to the ice. This curved surface 48 allows a rider to lift the front ice runner off of the ice and also to apply a brake to slow or stop the ice board 10.

For slowing or stopping forward momentum, the individual or rider shifts their weight to the rear portion 18 and presses down on the inclined section 22 to bring a brake member 25 into engagement with the ice by rotating the ice board on the curved rear surface 48 which causes one or more tangs 27 into contact with the ice surface.

Figure 5A:
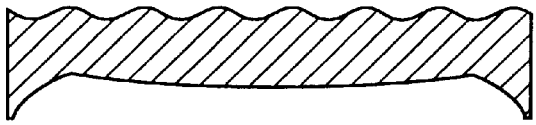
FIG. 5*a* is a cross-sectional view of an ice runner in accordance with a preferred embodiment of the invention; and, FIG. 5*b* is a cross-sectional view of an ice runner in accordance with a second embodiment of the invention.
Figure 5B:
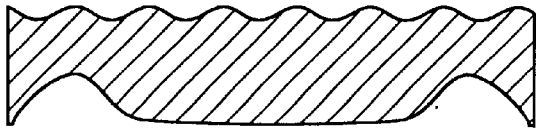

The cross sectional profile of the ice runners is shown schematically in FIGS. 5*a* and *b*. As illustrated in FIG. 5*a* the ice runner 26 may include a generally flat ice engaging surface 60 which extends transversely across the ice runner between two sharp acute angles 61 and 62. It is important to have relatively sharp edges particularly in the runner 24 so that the ice board will track along the curve of the edge when an individual or rider switches their weight toward the forward part of the elongated board 12 and leans slightly to one side in order to turn the board in that direction. An alternative form of a blade are shown in FIG. 5*b* wherein the portion between the two sharp edges are concave. A detailed discussion of the shape across the width of the ice runner can be found in U.S. Pat. No. 4,392,658 which is incorporated herein in its entirety by reference.

While the invention has been described in connection with the preferred embodiment it should be recognized that changes and modification maybe made therein without departing from the scope of the appended claims.

What is claimed is:

1. A skateboard for use on icy surfaces comprising:

an elongated board member having a top and a bottom surface, a front and a rear portion and a width of about 3 to 10 inches in said front and said rear portions and said board member adapted to support an individual in a generally upright position with one foot on said top surface of said forward portion and the other foot on said top surface of said rear portion and said rear portion of said elongated board member including an upwardly extending inclined section which forms an angle of about 20 degrees with a planar extension of said rear portion;

a pair of single in line ice runners including a front ice runner and a rear ice runner each of which have a longitudinally extending length and a thickness of about 1/16 to 3/16 inch with said forward ice runner disposed below said forward portion of said elongated board member and said rear ice runner disposed below said rear portion of said elongated board member forwardly of said inclined section, and each of said single ice runners having a longitudinally extending housing, a pair of mounting plates and a pair of connecting members connecting said housing to said connecting member for supporting said single ice runners in a near vertical position when said elongated board member is in a near horizontal position and means for fixing said mounting plates to said bottom surface of said elongated member and with said in line ice runners separated from one another by a distance of at least a length of the two ice runners combined;

said rear ice runner defining a flat ice engaging surface over at least 80 percent of its length, two longitudinally extending sharp edges and a shallow concave portion transversely of said edges, and said rear ice runner defining a curved portion at a rear part thereof curving upwardly toward said bottom surface with an arc of about 30 degrees with a radius of about ¾ inch to about 1½ inches;

a forward ice runner including two sharp edges transversely connected by a concave portion and a curved surface which curves upwardly toward the bottom surface of said forward portion toward a front of said elongated board member out of contact with the icy surface until an individual shifts their weight toward the forward portion of the board member to track the curve of said curved surface of said forward ice runner and wherein said curved surface extends over at least 80 percent of the length of said forward ice runner;

a downwardly extended ice engaging brake including at least one tang and fixed to and disposed below said inclined section and positioned so that in normal gliding usage of the skateboard said tang is out of contact with the ice and which engages the ice when weight is applied to said inclined section of said elongated board, and wherein said elongated member is free of other ice engaging elements.

2. A skateboard for use on icy surfaces according to claim 1, in which each of said runners has a thickness of about ⅛ inch and wherein said rear ice runner defines a curved portion at the rear part thereof curving upwardly toward said bottom surface with an arc of about 45 degrees and wherein said elongated board member includes an inclined rear portion which is inclined upwardly away from the icy surface by about 15 degrees and wherein said forward ice runner in which said front runner turns upwardly in front of the slight arc in order to ride over minor irregularities in the ice or small twigs.

* * * * *